US006964635B2

(12) United States Patent
Wang

(10) Patent No.: US 6,964,635 B2
(45) Date of Patent: Nov. 15, 2005

(54) EXERCISE APPARATUS

(76) Inventor: Wen-Ching Wang, No. 15, Fu-Chia Lane, Chen-Nan Rd., Sa-Lu Chen, Taichung Hsien (TW)

( * ) Notice: Subject to any disclaimer, the term of this patent is extended or adjusted under 35 U.S.C. 154(b) by 364 days.

(21) Appl. No.: 10/235,771

(22) Filed: Sep. 5, 2002

(65) Prior Publication Data

US 2004/0048724 A1 Mar. 11, 2004

(51) Int. Cl.[7] ..... A63B 21/00
(52) U.S. Cl. ..... 482/109; 482/104
(58) Field of Search ..... 473/422, 450, 473/464, 569, 577, 451, 426; 446/23, 6; 482/93, 482/109, 74, 103–104, 11, 907, 91

(56) References Cited

U.S. PATENT DOCUMENTS 885,927 A * 4/1908 Hulsmann ..... 482/87
1,187,029 A * 6/1916 Beebout ..... 473/604
1,493,282 A * 5/1924 Riddle ..... 81/488
2,718,644 A * 9/1955 Barr ..... 441/56
4,726,357 A * 2/1988 DeStefano ..... 601/41
5,092,588 A * 3/1992 DeLuca ..... 482/44
5,611,540 A * 3/1997 Williams et al. ..... 473/429
6,068,580 A * 5/2000 Myers et al. ..... 482/93
6,190,292 B1 * 2/2001 Panes ..... 482/93
6,547,703 B1 * 4/2003 Swezey et al. ..... 482/91

* cited by examiner

*Primary Examiner*—Jerome W. Donnelly
(74) *Attorney, Agent, or Firm*—Brinks Hofer Gilson & Lione

(57) ABSTRACT

An exercise apparatus includes a ball body having inner and outer skins, a coupling member having an anchoring part disposed between the inner and outer skins and an engaging part connected to the anchoring part, and a grip member having a handle part disposed exteriorly of the ball body and a fastening part that is connected to the handle part and that releasably engages the engaging part.

7 Claims, 11 Drawing Sheets

EXERCISE APPARATUS

BACKGROUND OF THE INVENTION

1. Field of the Invention

This invention relates to an exercise apparatus, more particularly to an exercise apparatus that includes an inflatable ball body with a grip member attached thereto.

2. Description of the Related Art

Conventionally, weight-training balls are normally formed with roughened surfaces or finger holes to improve handling thereof by the user and to permit various exercise, such as swinging and lifting. However, the conventional weight-training balls are disadvantageous in that the roughened surfaces have adverse effect on the bounding or rolling of the balls during exercise. Moreover, the ways of exercising using conventional weight-training balls are limited.

SUMMARY OF THE INVENTION

Therefore, it is an object of the present invention to provide an exercise apparatus that is capable of overcoming the aforesaid drawbacks.

According to the present invention, there is provided an exercise apparatus that comprises: an inflatable ball body having an inner skin confining an air chamber, and an outer skin that is attached to and that encloses the inner skin and that includes a first layer, the ball body being formed with at least a cavity between the inner skin and the first layer, the outer skin being formed with at least an access hole that is in spatial communication with the cavity and that extends radially and outwardly through the first layer; a coupling member mounted in the cavity and including at least an anchoring part that is attached to an inner periphery of the access hole within the cavity, and at least a handle-engaging part that is connected to the anchoring part and that is exposed from the access hole; and a grip member including a handle part that is disposed exteriorly of the ball body, and at least a handle-fastening part that is connected to the handle part, that extends into the access hole, and that releasably engages the handle-engaging part.

BRIEF DESCRIPTION OF THE DRAWINGS

In drawings which illustrate embodiments of the invention.

DETAILED DESCRIPTION OF THE PREFERRED EMBODIMENTS

Figure 1:
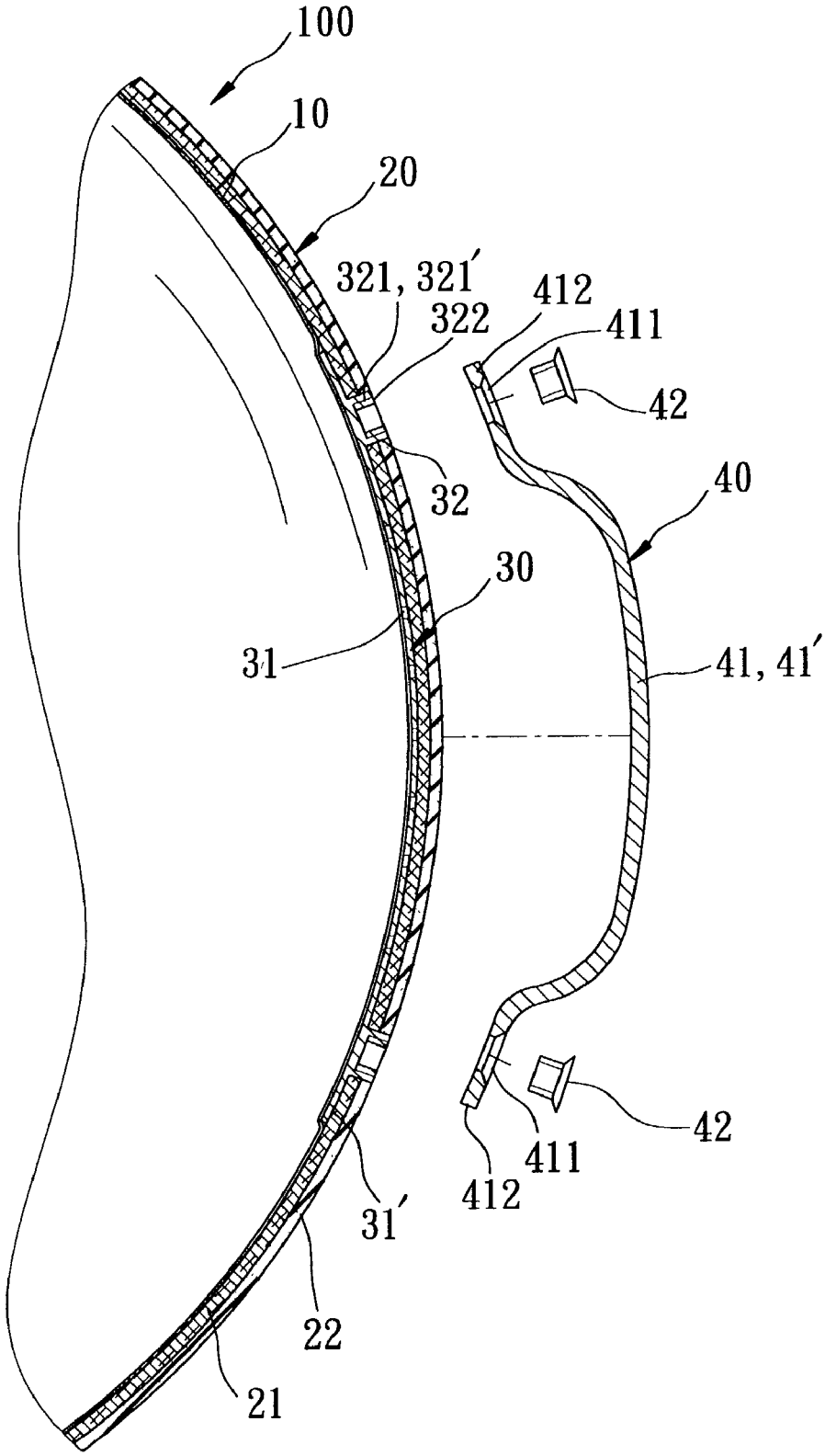
FIG. 1 is a fragmentary schematic exploded sectional view of a first preferred embodiment of an exercise apparatus according to the present invention.

For the sake of brevity, like elements are denoted by the same reference numerals throughout the disclosure.

Figure 2:
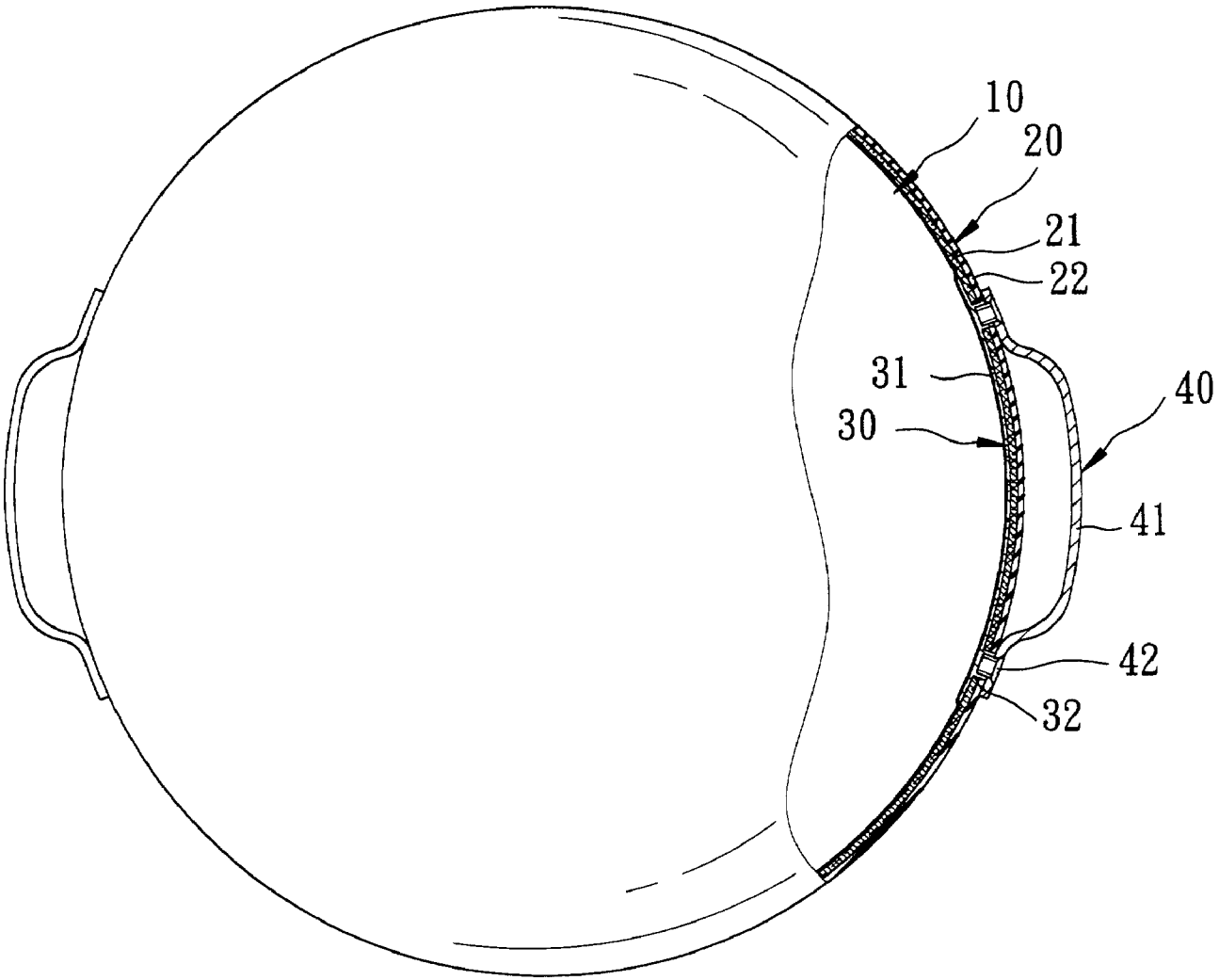
FIG. 2 is a cutaway, partly sectional view of the first preferred embodiment.

FIGS. 1 and 2 illustrate a first preferred embodiment of an exercise apparatus according to this invention for weight training. The exercise apparatus includes: an inflatable ball body 100 having an inner skin 10 confining an air chamber, and an outer skin 20 that is attached to and that encloses the inner skin 10 and that includes a first layer 22, the ball body 100 being formed with at least a cavity 31' between the inner skin 10 and the first layer 22, the outer skin 20 being formed with at least an access hole 32 that is in spatial communication with the cavity 31' and that extends radially and outwardly through the first layer 22; a coupling member 30 mounted in the cavity 31' and including at least an anchoring part 31 that is attached to an inner periphery of the access hole 32 within the cavity 31', and at least a handle-engaging part 321 that is connected to the anchoring part 31 and that is exposed from the access hole 32; and a grip member 40 including a handle part 41 that is disposed exteriorly of the ball body 100, and at least a handle-fastening part 42 that is connected to the handle part 41, that extends into the access hole 32, and that releasably engages the handle-engaging part 321.

In the first embodiment, the outer skin 20 further includes a fabric layer 21 sandwiched between the inner skin 10 and the first layer 22. The first layer 22 is made from a vulcanized rubber material. The cavity 31' is formed between the inner skin 10 and the fabric layer 21. The outer skin 20 is formed with a pair of the access holes 32. The coupling member 30 includes a pair of the handle-engaging parts 321. The grip member 40 includes a pair of the handle-fastening parts 42. The anchoring part 31 is attached to the fabric layer 21. Each of the handle-engaging parts 321 includes a threaded tubular piece 321' that extends outwardly and radially relative to the ball body 100 from the anchoring part 31 into a respective one of the access holes 32, and that is formed with an inner thread 322. The handle part 41 includes a generally U-shaped bar 41' that has two opposite ends 412 respectively attached to outer peripheries of the access holes 32 and formed with through-holes 411 which are respectively aligned with the access holes 32. Each of the handle-fastening parts 42 is in the form of a screw that extends through a respective one of the through-holes 411 and into the threaded tubular piece 321' of a respective one of the handle-engaging parts 321, and that threadedly engages the inner thread 322 of the threaded tubular piece 321' so as to secure the grip member 40 to the ball body 100.

Figure 3:
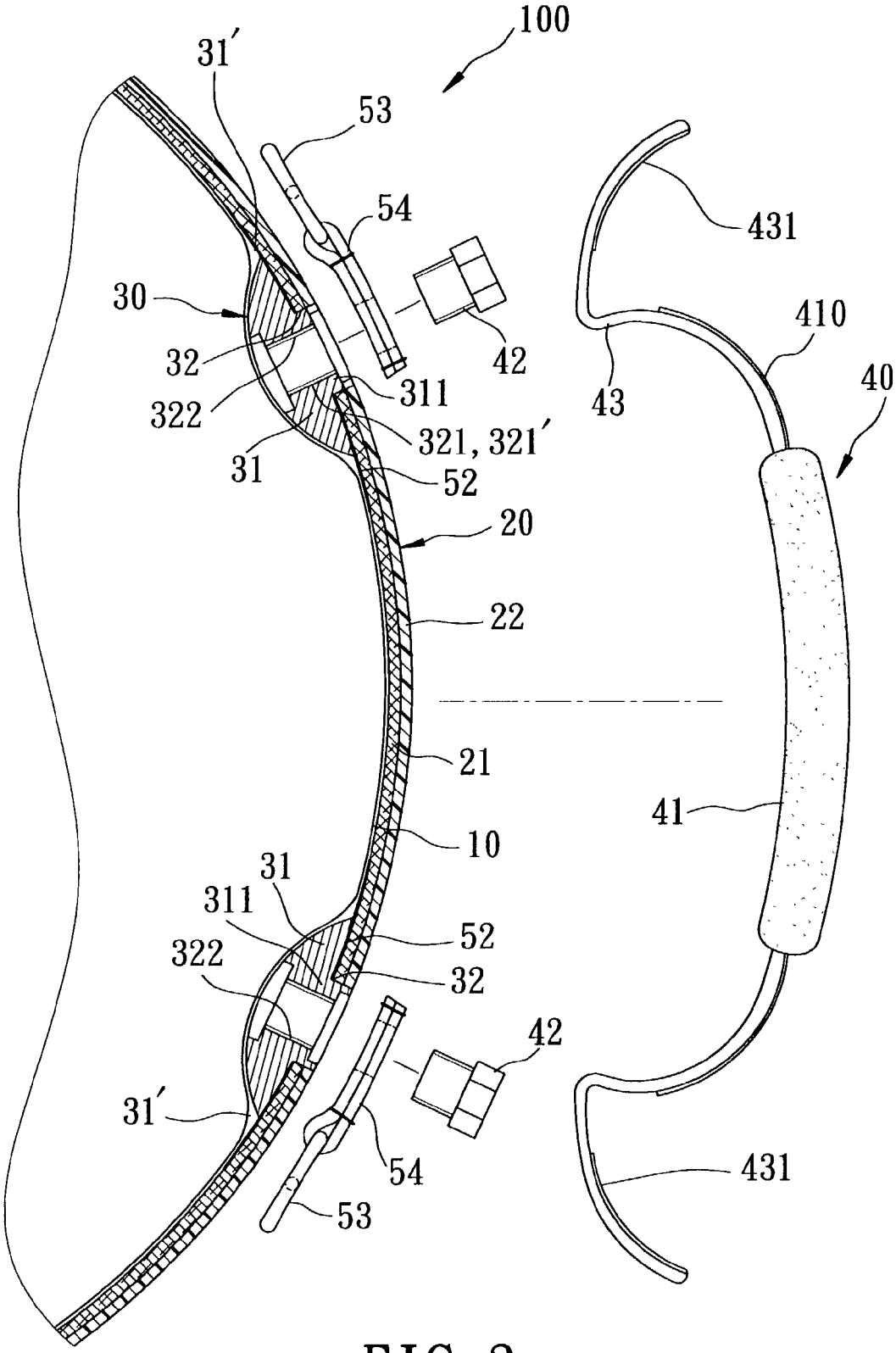
FIG. 3 is a fragmentary schematic exploded sectional view of a second preferred embodiment of the exercise apparatus according to the present invention.
Figure 4:
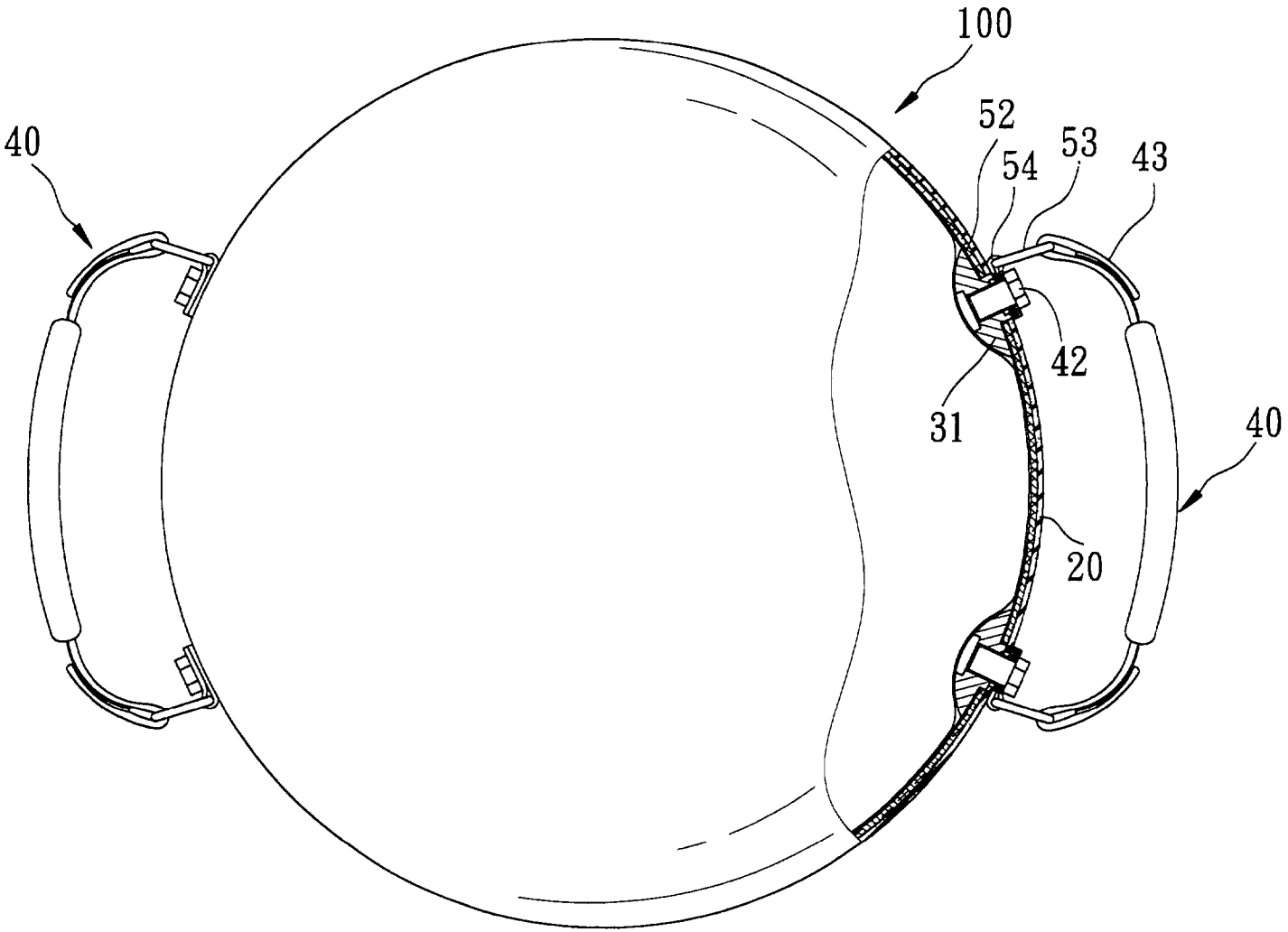
FIG. 4 is a cutaway, partly sectional view of the second preferred embodiment.

FIGS. 3 and 4 illustrate a second preferred embodiment of the exercise apparatus that is modified from and that is similar to the previous embodiment shown in FIG. 1. In this embodiment, the ball body 100 is formed with a pair of the cavities 31' between the inner skin 10 and the fabric layer 21. The outer skin 20 is formed with a pair of the access holes 32. The coupling member 30 includes a pair of adhesive tapes 52, a pair of the anchoring parts 31, and a pair of the handle-engaging parts 321. The grip member 40 includes a pair of the handle-fastening parts 42. Each of the anchoring parts 31 is disposed in a respective one of the cavities 31', is attached to the fabric layer 21 via a respective one of the adhesive tapes 52, and has a hollow central portion 311 that extends outwardly and radially toward a respective one of the access holes 32. Each of the handle-engaging parts 321 includes a threaded tubular piece 321' that is mounted in the central portion 311 of a respective one of the anchoring parts 31, and that is formed with an inner thread 322. The handle part 41 includes a pair of fastening rings 53 with fastening ends 54, and a generally U-shaped strap 410 that has two opposite ends 431 formed with fastening loops 43 which engage the fastening rings 53, respectively. Each of the handle-fastening parts 42 is in the form of a screw that extends through a respective one of the fastening ends 54 of the fastening rings 53 and into a respective one of the threaded tubular pieces of the handle-engaging parts 321, and that threadedly engages the inner thread 322 of the respective one of the threaded tubular pieces.

Figure 5:
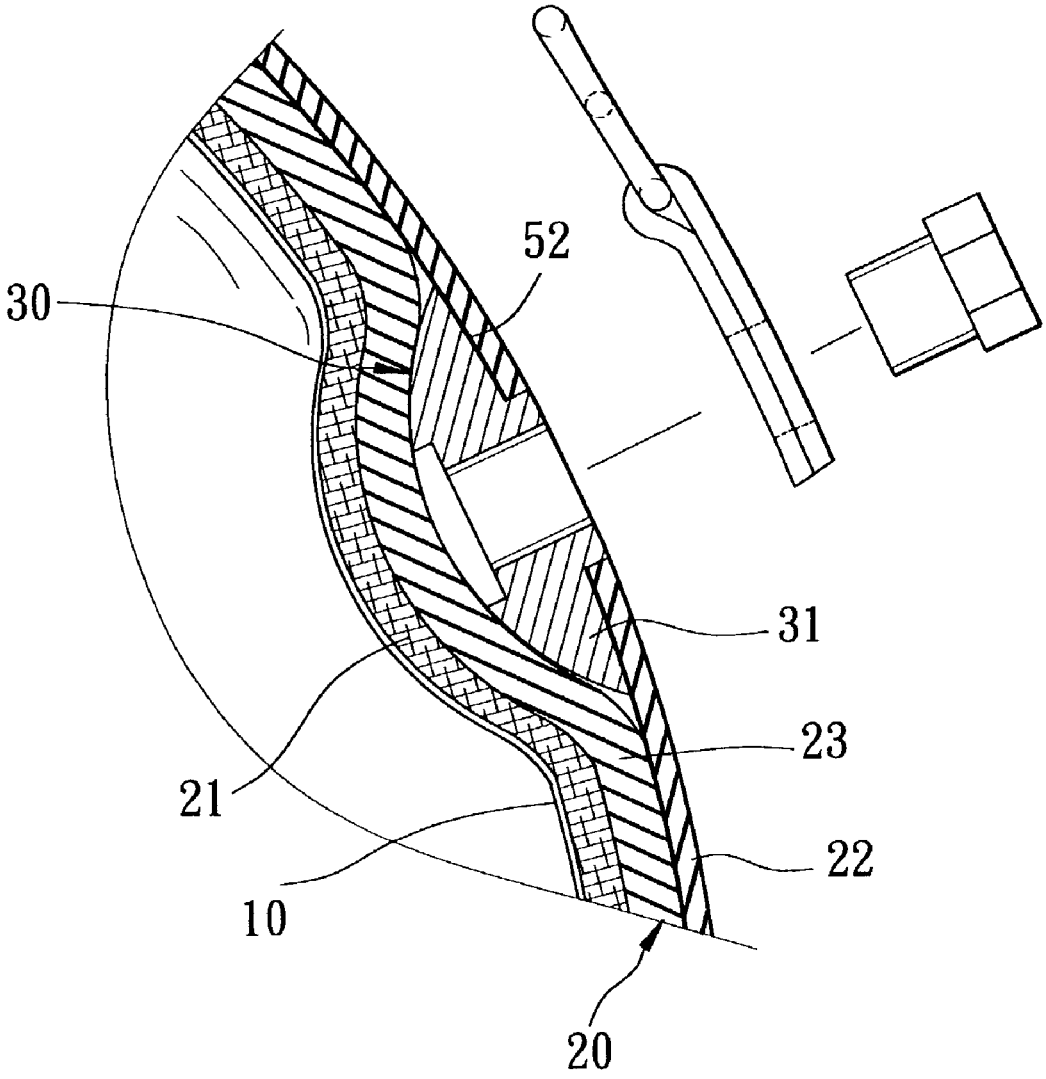
FIG. 5 is a fragmentary schematic exploded sectional view of a third preferred embodiment of the exercise apparatus according to the present invention.

FIG. 5 illustrates a third preferred embodiment of the exercise apparatus that is modified from and that is similar to the second embodiment shown in FIG. 3. In this embodiment, a second layer 23 is sandwiched between the fabric layer 21 and the first layer 22. The first and second layers 22, 23 are made from a vulcanized rubber material. The cavity 31' is formed between the first and second layers 22, 23. The anchoring part 31 is attached to the first layer 22 via the adhesive tape 52.

Figure 6:
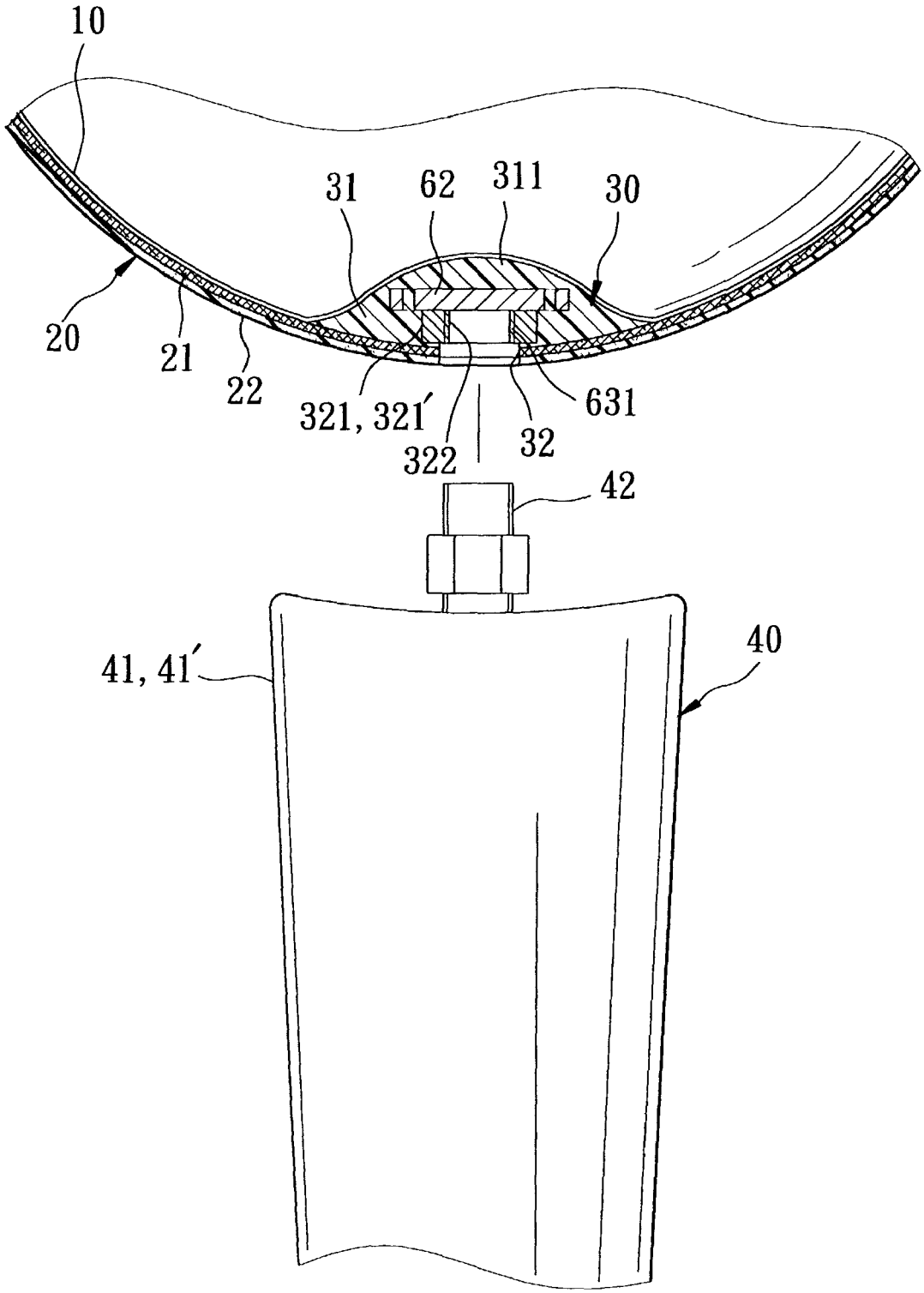
FIG. 6 is a fragmentary schematic exploded sectional view of a fourth preferred embodiment of the exercise apparatus according to the present invention.
Figure 7:
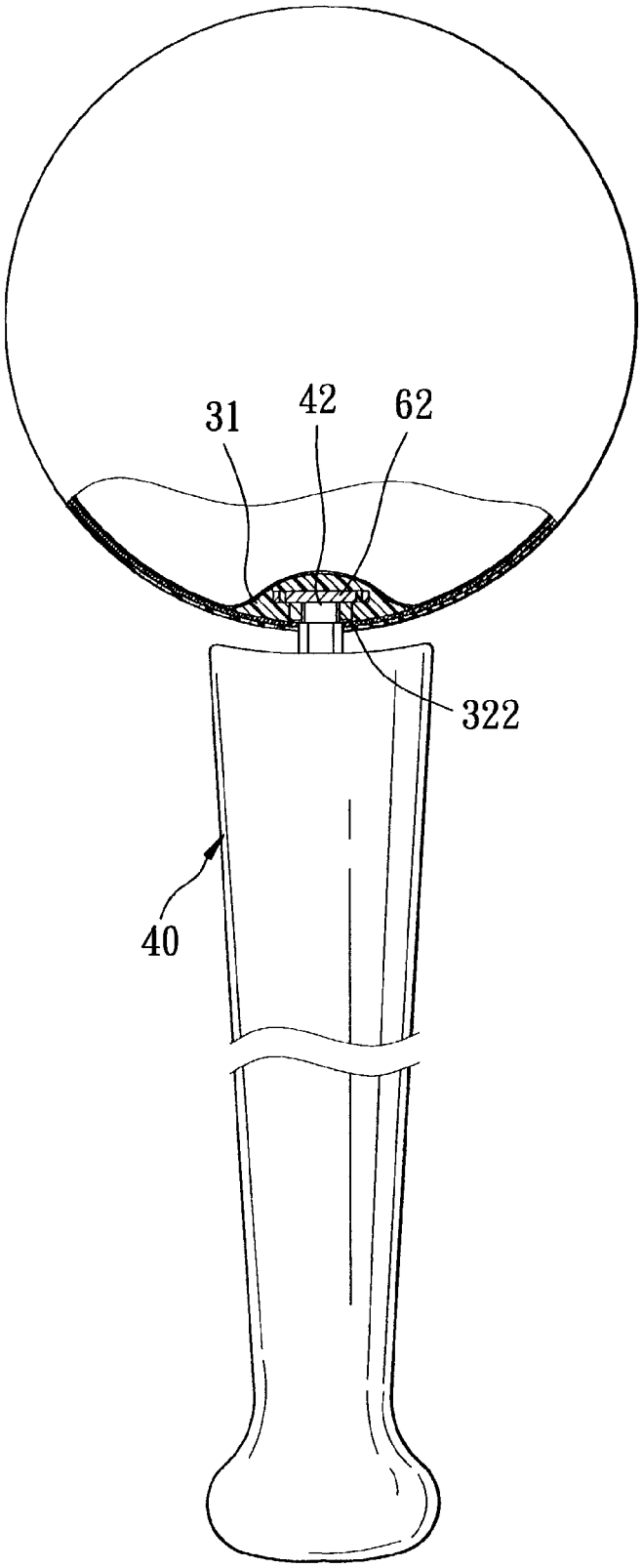
FIG. 7 is a cutaway, partly sectional view of the fourth preferred embodiment.

FIGS. 6 and 7 illustrate a fourth preferred embodiment of the exercise apparatus that is modified from and that is similar to the second embodiment shown in FIG. 3. In this embodiment, the anchoring part 31 is attached to the fabric layer 21 and has a hollow central portion 311 that extends radially and outwardly toward the access hole 32. The handle-engaging part 321 includes a holding piece 62 mounted securely in the central portion 311, and a threaded tubular piece 321' that extends from the holding piece 62, and that is formed with an inner thread 322. The handle part 41 includes a bat 41' with a connecting end. The handle-fastening part 42 is in the form of a screw that is connected to the connecting end of the bat 41', that extends into the threaded tubular piece 321', and that threadedly engages the inner thread 322.

Figure 8:
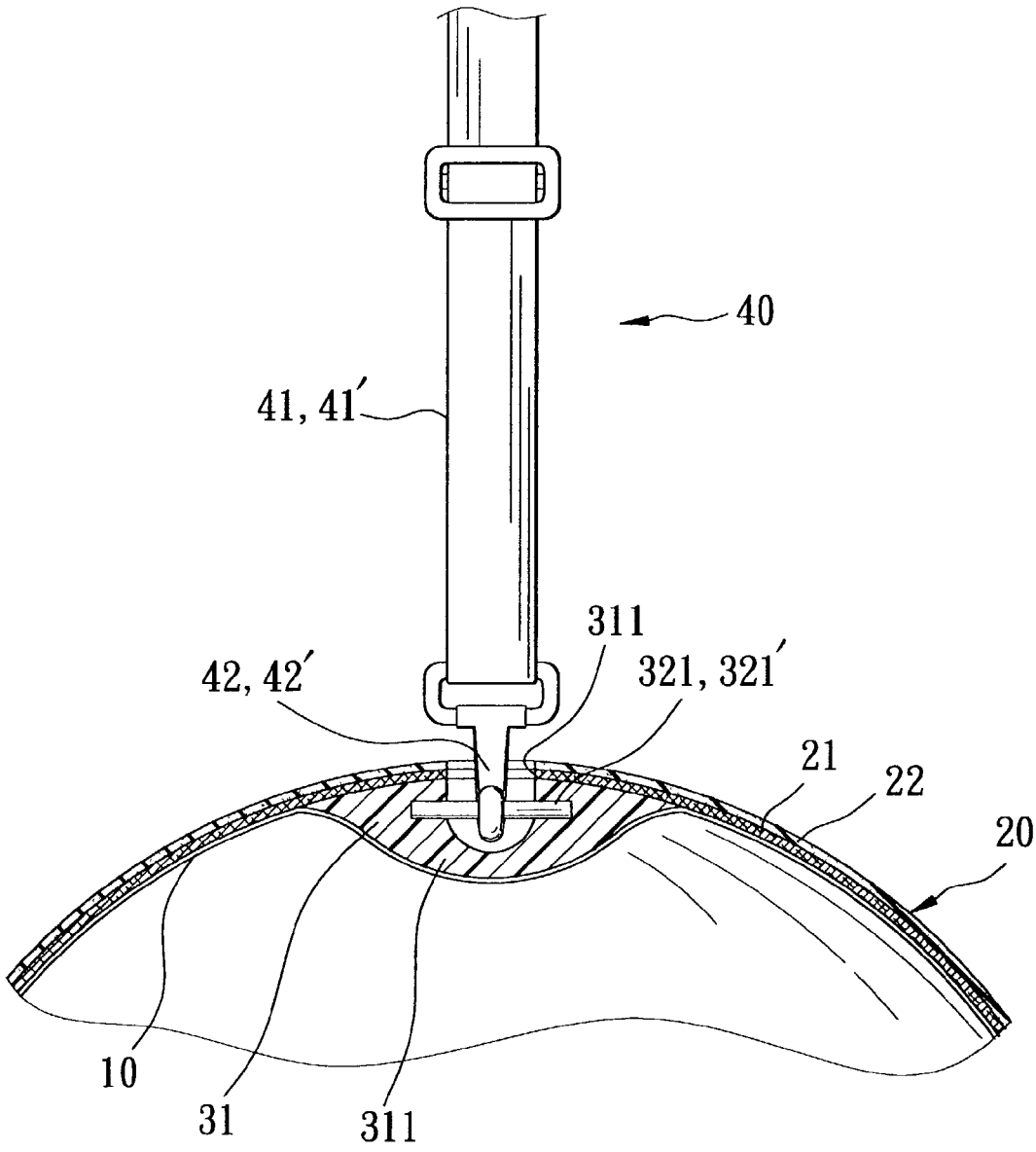
FIG. 8 is a fragmentary schematic sectional view of a fifth preferred embodiment of the exercise apparatus according to the present invention.

FIG. 8 illustrates a fifth preferred embodiment of the exercise apparatus that is modified from and that is similar to the fourth embodiment shown in FIG. 6. In this embodiment, the handle-engaging part 321 includes a hook-holding piece 321' mounted securely in the central portion 311. The handle part 41 includes a belt 41'. The handle-fastening part 42 includes a hook 42' that is connected to the belt 41', that extends into the central portion 311, and that engages the hook-holding piece 321'.

Figure 9:
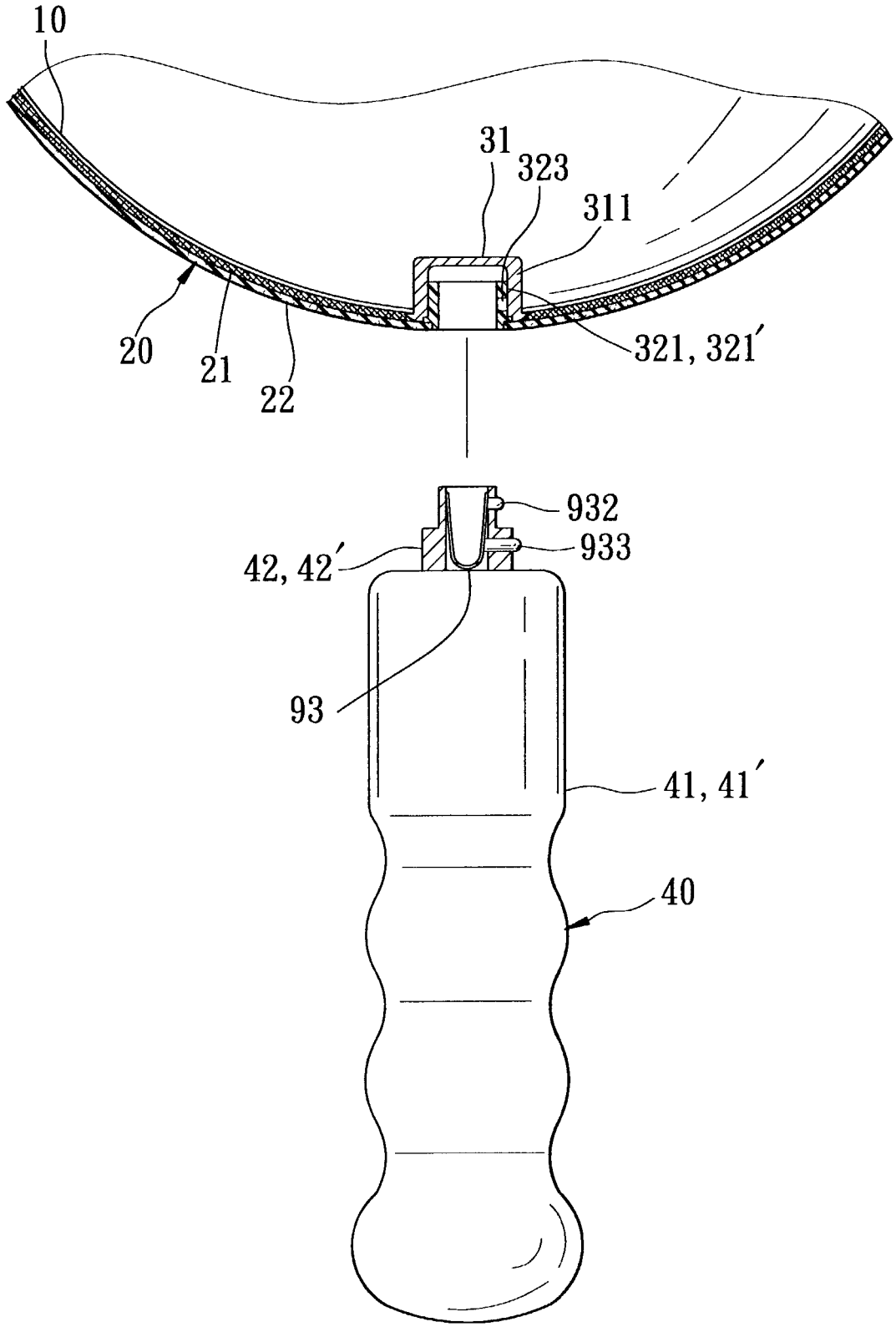
FIG. 9 is a fragmentary schematic exploded sectional view of a sixth preferred embodiment of the exercise apparatus according to the present invention.
Figure 10:
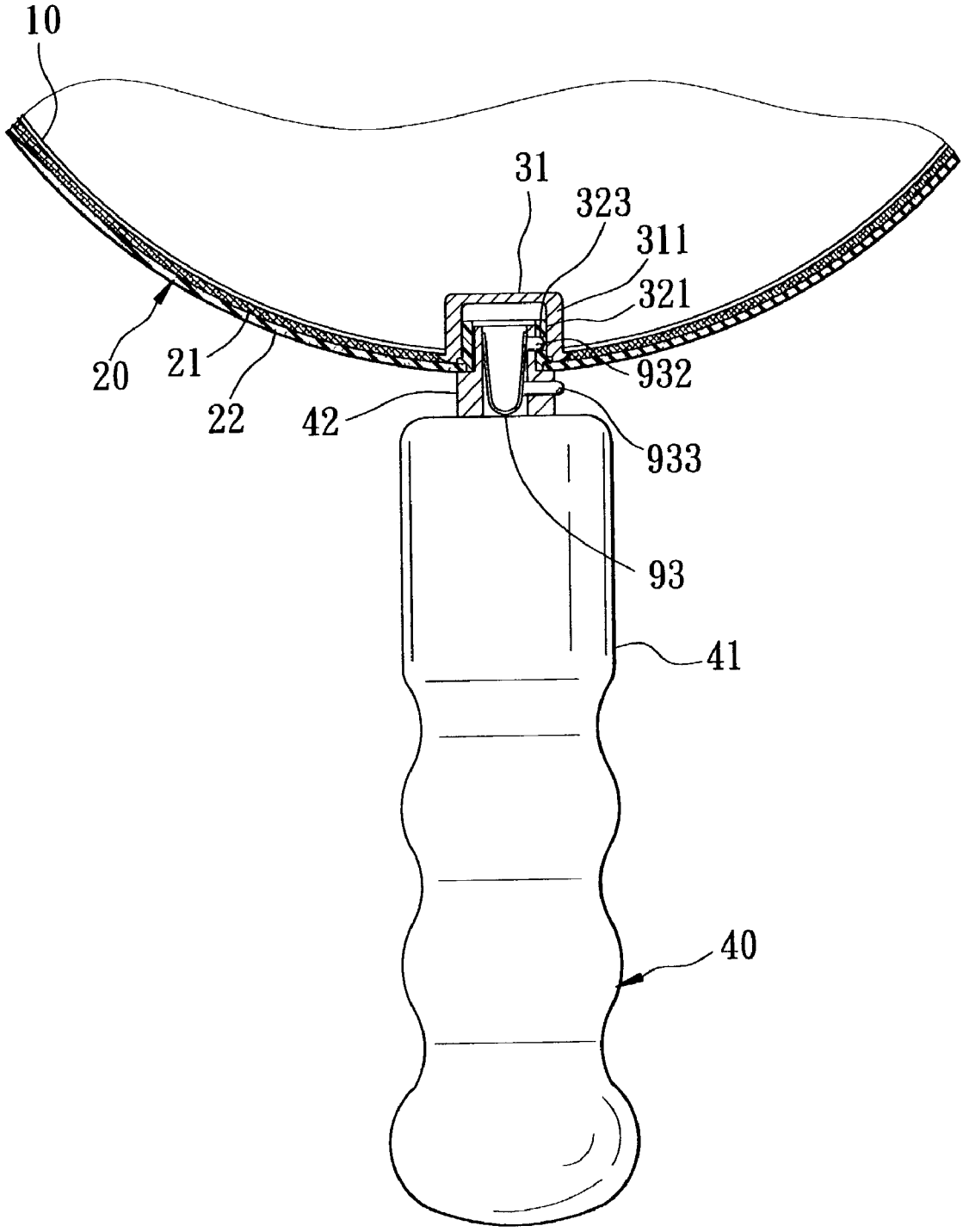
FIG. 10 is a fragmentary schematic sectional view of the sixth preferred embodiment.

FIGS. 9 and 10 illustrate a sixth preferred embodiment of the exercise apparatus that is modified from and that is similar to the fourth embodiment shown in FIG. 6. In this embodiment, the handle-engaging part 321 includes a tubular piece 321' mounted in the central portion 311 and formed with a retaining groove 323. The handle part 41 includes a grip piece 41' with a connecting end. The handle-fastening part 42 includes a tubular element 42' connected to the connecting end of the grip piece 41', an engaging tongue 932 projecting outwardly and movably from the tubular element 42', a releasing protrusion 933 projecting outwardly and movably from the tubular element 42', and an urging member 93 mounted in the tubular element 42', connected to the engaging tongue 932, and urging the engaging tongue 932 and the releasing protrusion 933 in such a manner that the engaging tongue 932 extends into and engages the retaining groove 323 when the tubular element 42' extends into the tubular piece 321', and that the engaging tongue 932 disengages from the retaining groove 323 when the releasing protrusion 933 is pressed against the urging member 93.

Figure 11:
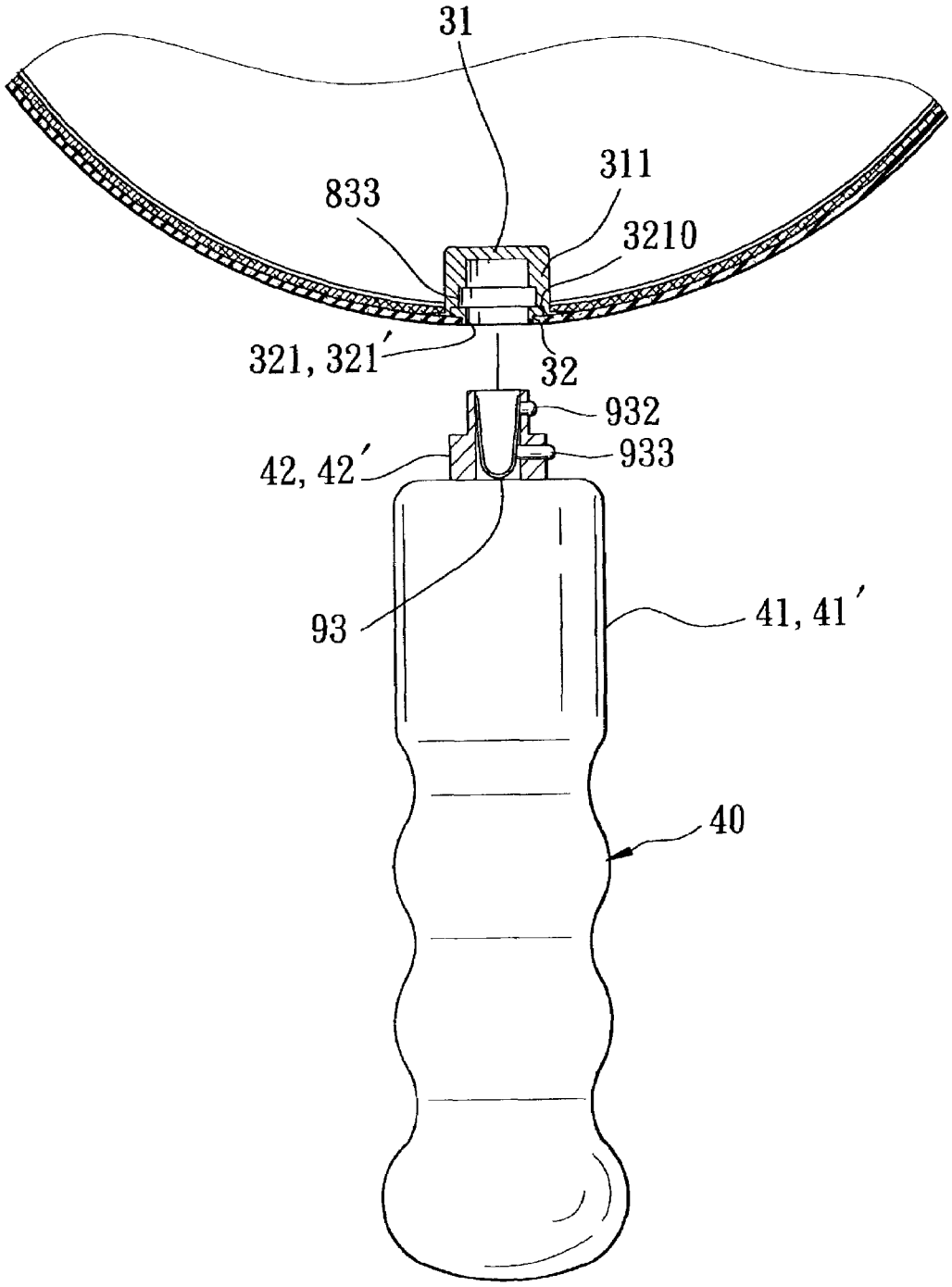
FIG. 11 is a fragmentary schematic exploded sectional view of a seventh preferred embodiment of the exercise apparatus according to the present invention.

FIG. 11 illustrates a seventh preferred embodiment of the exercise apparatus that is modified from and that is similar to the sixth embodiment shown in FIG. 9. In this embodiment, the handle-engaging part 321 including a tubular piece 321' mounted in the access hole 32 and having a flange portion 3210 that is sandwiched between the central portion 311 and the inner periphery of the access hole 32, and that cooperates with the central portion 311 to form with a retaining groove 833 therebetween. The handle part 41 includes a grip piece 41' with a connecting end. The handle-fastening part 42 includes a tubular element 42' connected to the connecting end of the grip piece 41', an engaging tongue 932 projecting outwardly and movably from the tubular element 42', a releasing protrusion 933 projecting outwardly and movably from the tubular element 42', and an urging member 93 mounted in the tubular element 42', connected to the engaging tongue 932, and urging the engaging tongue 932 and the releasing protrusion 933 in such a manner that the engaging tongue 932 extends into and engages the retaining groove 833 when the tubular element 42' extends into the tubular piece 321', and that the engaging tongue 932 disengages from the retaining groove 833 when the releasing protrusion 933 is pressed against the urging member 93.

With the inclusion of the coupling member 30 and the grip member 40 in the exercise apparatus of this invention, the aforesaid drawbacks associated with the prior art can be eliminated.

With the invention thus explained, it is apparent that various modifications can be made without departing from the spirit of the present invention. It is therefore intended that the invention be limited only as recited in the appended claims.

I claim:

1. An exercise apparatus comprising:

an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said outer skin is formed with a pair of said access holes, said coupling member including a pair of said handle-engaging parts, said grip member including a pair of said handle-fastening parts, said anchoring part being attached to said fabric layer, each of said handle-engaging parts including a threaded tubular piece that extends outwardly and radially relative to said ball body from said anchoring part into a respective one of said access holes, and that is formed with an inner thread, said handle part including a generally U-shaped bar that has two opposite ends respectively attached to outer peripheries of said access holes and formed with through-holes which are respectively aligned with said access holes, each of said handle-fastening parts being in the form of a screw that extends through a respective one of said through-holes and into said threaded tubular piece of a respective one of said handle-engaging parts, and that threadedly engages said inner thread of said threaded tubular piece so as to secure said grip member to said ball body.

2. An exercise apparatus comprising: an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said ball body is formed with a pair of said cavities between said inner skin and said fabric layer, said outer skin being formed with a pair of said access holes, and a pair of said member including a pair of adhesive tapes, a pair of said anchoring parts, and a pair of said handle-engaging parts, said grip member including a pair of said handle-fastening parts, each of said anchoring parts being disposed in a respective one of said cavities, being attached to said fabric layer via a respective one of said adhesive tapes, and having a hollow central portion of that extended outwardly and radially toward a respective one of said access holes, each of said handle-engaging parts including a threaded tubular piece that is mounted in said central portion of a respective one of said anchoring parts, and that is formed with an inner thread, said handle part including a pair of fastening rings with fastening ends, and a generally U-shaped strap that has two opposite ends formed with fastening loops which engage said fastening rings, respectively, each of said handle-fastening parts being in the form of a screw that extends through a respective one of said fastening ends of said fastening rings and into a respective one of said threaded tubular pieces of said handle-engaging parts, and that threadedly engage said inner thread of the respective one of said threaded tubular pieces so as to secure said grip member to said ball body.

3. The exercise apparatus of claim 2, further comprising second layer which is sandwiched between said inner skin and said first layer, said cavity being formed between said first and second layers, said coupling member further including an adhesive tape for attaching said anchoring part to said first layer.

4. An exercise apparatus comprising: an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said anchoring part is attached to said fabric layer and has a hollow central portion that extends radially and outwardly toward said access hole, said handle-engaging part including a holding piece mounted securely in said central portion, and a threaded tubular piece that extends from said holding piece, and that is formed with an inner thread, said handle part including a bat with a connecting end, said handle-fastening part being in the form of a screw that is connected to said connecting end of said bat, that extends into said threaded tubular piece, and that threadedly engages said inner thread.

5. An exercise apparatus comprising: an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said anchoring part is attached to said fabric layer and has a hollow central portion that extends radially and outwardly toward said access hole, said handle-engaging part including a hook-holding piece mounted securely in said central portion, said handle part including a belt, said handle-fastening part including a hook that is connected to said belt, that extends into said central portion, and that engages said hook-holding piece.

6. An exercise apparatus comprising: an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said anchoring part is attached to said first layer, and has a hollow central portion that extends radially and outwardly toward said access hole, said handle-engaging part including a tubular piece mounted in said central portion and formed with a retaining groove, said handle part including a grip piece with a connecting end, said handle-fastening part including a tubular element connected to said connecting end of said grip piece, an engaging tongue projecting outwardly and movably from said tubular element, a releasing protrusion projecting outwardly and movably from said tubular element, and an urging member mounted in said tubular element, connected to said engaging tongue, and urging said engaging tongue and said releasing protrusion in such a manner that said engaging tongue extends into and engages said retaining groove when said tubular element extends into said tubular piece, and that said engaging tongue disengages from said retaining groove when said releasing protrusion is pressed against said urging member.

7. An exercise apparatus comprising: an inflatable ball body having an inner skin confining an air chamber, and an outer skin that is attached to and that encloses said inner skin and that includes a first layer, said ball body being formed with at least a cavity between said inner skin and said first layer, said outer skin being formed with at least an access hole that is in spatial communication with said cavity and that extends radially and outwardly through said first layer;

a coupling member mounted in said cavity and including at least an anchoring part that is attached to an inner periphery of said access hole within said cavity, and at least a handle-engaging part that is connected to said anchoring part and that is exposed from said access hole;

a grip member including a handle part that is disposed exteriorly of said ball body, and at least a handle-fastening part that is connected to said handle part, that extends into said access hole, and that releasably engages said handle-engaging part;

wherein said outer skin further includes a fabric layer sandwiched between said inner skin and said first layer, said first layer being made from a vulcanized rubber material, said cavity being formed between said inner skin and said fabric layer; and wherein said anchoring part is attached to said first layer, and has a hollow central portion that extends radially and outwardly toward said access hole, said handle-engaging part including a tubular piece mounted in said access hole and having a flange portion that is sandwiched between said central portion and said inner periphery of said access hole, and that cooperates with said central portion to form a retaining groove therebetween, said handle part including a grip piece with a connecting end, said handle-fastening part including a tubular element connected to said connecting end of said grip piece, an engaging tongue projecting outwardly and movably from said tubular element, a releasing protrusion projecting outwardly and movably from said tubular element, and an urging member mounted in said tubular element, connected to said engaging tongue, and urging said engaging tongue and said releasing protrusion in such a manner that said engaging tongue extends into and engages said retaining groove when said tubular element extends into said tubular piece, and that said engaging tongue disengages from said engaging tongue when said releasing protrusion is pressed against said urging member.

* * * * *